US006172028B1

(12) United States Patent
Baur et al.

(10) Patent No.: US 6,172,028 B1
(45) Date of Patent: Jan. 9, 2001

(54) DETERGENT AND TABLEWARE CLEANER

(75) Inventors: Richard Baur, Mutterstadt; Werner Bertleff, Viernheim; Birgit Potthoff-Karl; Beate Ehle, both of Ludwigshafen; Matthias Kroner, Eisenberg; Gunnar Schornick, Neuleiningen, all of (DE)

(73) Assignee: BASF Aktiengesellschaft, Ludwigshafen (DE)

( * ) Notice: Under 35 U.S.C. 154(b), the term of this patent shall be extended for 0 days.

(21) Appl. No.: 09/155,410

(22) PCT Filed: Mar. 25, 1997

(86) PCT No.: PCT/EP97/01511

§ 371 Date: Sep. 28, 1998

§ 102(e) Date: Sep. 28, 1998

(87) PCT Pub. No.: WO97/35949

PCT Pub. Date: Oct. 2, 1997

(30) Foreign Application Priority Data

Mar. 26, 1996 (DE) ..... 196 11 989

(51) Int. Cl.[7] ..... C11D 3/30; C11D 3/37; C11D 7/08

(52) U.S. Cl. ..... 510/361; 510/336; 510/350; 510/433; 510/434; 510/477; 510/488; 510/499; 510/514

(58) Field of Search ..... 510/336, 361, 510/350, 433, 434, 477, 488, 499, 514

(56) References Cited

U.S. PATENT DOCUMENTS 4,687,592 * 8/1987 Collins et al. ..... 252/99

FOREIGN PATENT DOCUMENTS

| | | | |
|---|---|---|---|
| 773 260 | | 3/1972 | (BE) . |
| 195 32 717 | | 3/1997 | (DE) . |
| 0 173 398 | | 3/1986 | (EP) . |
| 2172910 | * | 10/1986 | (GB) . |
| WO 86/07603 | | 12/1986 | (WO) . |

* cited by examiner

*Primary Examiner*—Gregory R. Delcotto
(74) *Attorney, Agent, or Firm*—Oblon, Spivak, McClelland, Maier & Neustadt, P.C.

(57) ABSTRACT

A mixture comprising (a) from 0.1 to 99% by weight of at least one polycarboxylate having at least 3 carboxyls, (b) from 0.1 to 99% by weight of at least one amine having a $pK_a$ value of more than 9, and (c) from 0.1 to 99% by weight of at least one acid selected from the group consisting of mineral acids and organic acids having one or two carboxyls and not more than 10 carbons, with the proviso that the mixture contains less than 24% by weight of triphosphates, is used in detergent and rinse aid formulations.

8 Claims, No Drawings

DETERGENT AND TABLEWARE CLEANER

The invention relates to mixtures comprising at least one polycarboxylate, at least one amine and at least one acid, to detergents containing them, and to their use as encrustation inhibitors in detergents and as encrustation inhibitors and scale inhibitors in rinse aids.

BE 773 260 describes detergents containing in addition to LAS and tripolyphosphate as softener component N-alkylpropanediamines, especially N-dodecylpropane-1,3-diamine, N-cocopropane-1,3-diamine or N-tallow fatty-propane-1,3-diamine.

EP-A-0 173 398 describes detergent compositions comprising a mixture of long-chain primary or secondary amines and cellulase as the essential textile softener ingredients. The amine used can be tallow fatty amine. The compositions may include alkali metal phosphates and polycarboxylates in addition to LAS and sodium triphosphate.

WO 86/07603 describes detergents for low washing temperatures which may contain ether amines, amido amines, glucamine or morpholine derivatives, and polycarboxylic acids.

GB-A-2 172 910 describes detergent compositions having textile softener properties. For this purpose use is made of specific primary, secondary or tertiary amines having a long-chain hydrocarbyl radical, especially N,N-dimethyllaurylamine or N-dimethylcocoamine, which may be mixed with a Brönstedt acid as dispersant. Acids mentioned include inorganic acids and organic acids, such as polymeric carboxylic acids. Monocarboxylic acids are preferred. The composition include LAS and sodium tripolyphosphate.

DE-A-195 32 717 describes detergents containing modified polyaspartic acids as encrustation inhibitors. The polyaspartic acids are polycondensation products of aspartic acid, certain amines, and phosphorus-containing acids.

WO 95/33035 describes detergent compositions which are particularly effective for removing fatty or oily dirt from substrates such as textile products or crockery. One detergent composition contains 0.5% by weight of 1-hexylamine, 9.0% by weight of $C_{12-16}$ fatty acid and 6.0% by weight of anhydrous citric acid, and also 10.0% by weight of oleyl sarcosinate.

It is an object of the present invention to provide encrustation inhibitors for detergents and rinse aids.

It is another object of the present invention to provide encrustation inhibitors for reduced-phosphate or phosphite-free detergents and rinse aids.

It is yet another object of the present invention to provide detergents and rinse aids comprising novel encrustation inhibitors.

It is a further object of the present invention to provide encrustation inhibitors for detergents and rinse aids which are easier to prepare than the aspartic acid polycondensates and which have a better action.

It is a further object to provide scale inhibitors for dishwashing compositions.

It is a further object to provide dishwashing compositions which comprise scale inhibitors.

It is a further object to provide scale inhibitors for dishwashing compositions that have a better action than conventional polycarboxylates.

We have found that these objects are achieved by a mixture comprising (a) from 0.1 to 99% by weight of at least one polycarboxylate having at least 3 carboxyls, (b) from 0.1 to 99% by weight of at least one amine having a $pK_a$ value of more than 9, and (c) from 0.1 to 99% by weight of at least one acid selected from the group consisting of mineral acids and organic acids having one or two carboxyls and not more than 10 carbons, with the proviso that the mixture contains less than 24% by weight of triphosphates and the total amount of the ingredients is 100% by weight, and by the use of this mixture in detergent or rinse aid formulations.

It has been found in accordance with the invention that mixtures comprising (a) from 0.1 to 99% by weight, preferably from 30 to 97% by weight, in particular from 50 to 95% by weight, of at least one polycarboxylate having at least 3 carboxyls, (b) from 0.1 to 99% by weight, preferably from 0.5 to 50% by weight, in particular from 1 to 25% by weight, of at least one amine having a $pK_a$ of more than 9, preferably from 9.5 to 12, and (c) from 0.1 to 99% by weight, preferably from 0.3 to 50% by weight, in particular from 0.5 to 40% by weight, of at least one acid selected from the group consisting of mineral acids and organic acids having one or two carboxyls and not more than 10 carbons, with the proviso that the mixture contains less than 24% by weight, preferably not more than 20% by weight, of triphosphates and the total amount of the ingredients is 100% by weight, have encrustation-inhibiting and scale-inhibiting properties which are better than those of pure polycarboxylates as described, for example, in DE-A-195 32 717.

A description will first be given of components (a), (b) and (c) of the novel mixtures.

Component (a)

Polycarboxylates which can be used in accordance with the invention have at least three carboxyl groups. These novel polycarboxylates may be monomeric compounds or may be polymeric compounds having a molecular weight distribution. It is possible to employ both naturally occurring and synthetic polycarboxylates. According to a preferred embodiment, the polycarboxylates used are biodegradable or can be eliminated in sewage plants. According to one embodiment of the invention, the weight-average molecular weights of the polycarboxylates are from 100 to 300,000, preferably from 800 to 500,000, in particular from 800 to 200,000.

According to one embodiment of the invention, low molecular mass carboxylates having 3 to 10 carboxyls are used. Examples of suitable low molecular mass polycarboxylates are those of citric acid, isocitric acid, nitrilotriacetic acid, ethylenediaminetetraacetic acid, isoserinediacetic acid, β-alaninediacetic acid, diethylenetriaminepentaacetic acid, hydroxyethyldiamine triacetic acid, propylenediaminetetraacetic acid, methylglycinediacetic acid, cyclohexanehexacarboxylic acid and alkylglycinediacetic acids having 2 to 24 carbons in the alkyl radical. According to one embodiment of the invention, the carboxylates are devoid of aromatic radicals.

Examples of polycarboxylates which can be used according to one embodiment of the invention are proteins containing aspartic acid or glutamic acid, such as casein, gelatine, wheat proteins, soya proteins, pea proteins, polyaspartic acid, polyglutamic acid, and polycocondensates of aspartic acid and/or carboxylic acids. According to one embodiment of the invention it is advantageous to lower the molecular weight of the proteins, preferably to a weight-average molecular weight of from 800 to 200,000, by subjecting them, for example, to an oxidative, reductive or hydrolytic treatment. Hydrolytic treatment can be carried out with the aid of enzymes, acids or bases.

Other polycarboxylates which can be used are polymeric sugar acids, such as pectic acid, or oxidized polysaccharides, such as oxidized starch, oxidized maltodextrins or oxidized cellulose. The degree of oxidation may differ. For example, in the case of starch only the primary $CH_2OH$ groups in position $C_6$ to the carboxyl group may be oxidized, with the formation of monocarboxy starch. However, oxidation may also occur with diol cleavage between $C_2$ and $C_3$ to form the dialdehyde starch, and further oxidation to the dicarboxy starch , or with oxidation of all three carbons in positions $C_6$, $C_2$ and $C_3$, to give the tricarboxy starch. All oxidized polysaccharides of this type can be employed, preferably those having a weight-average molecular weight of from 800 to 500,000. The polysaccharides may also be etherified or esterified. Etherification can be carried out with the chloroacetic acid. Examples are carboxylmethyl starch or carboxylmethylcellulose. Examples of esterified starches are acid citric esters of the starches, which are prepared by esterifying starch with excess citric acid.

According to one embodiment of the invention it is also possible to employ polyesters which have been prepared by esterifying polyols, such as ethylene glycol, polyethylene glycol, polyalkylene glycols, glycerol, mannitol, sorbitol and polyvinyl alcohol, with citric acid, tartaric acid or malic acid, or butanetetracarboxylic acid.

Synthetic polycarboxylates which can be used in accordance with one embodiment of the invention are advantageously prepared by free-radical polymerization of unsaturated monomers. Examples of monomers employed are acrylic acid, maleic acid, maleic anhydride, methacrylic, itaconic, aconitric, vinylsulfonic, methallylsulfonic and cinnamic acid, acrylic esters, such as methyl, butyl, ethylhexyl, oleyl and stearyl acrylates and tallow fatty alcohol acrylate, mono- and dialkyl maleates, such as mono- and dimethyl maleates, mono- and diethyl maleates, mono- and diisopropyl maleates, mono- and dibutyl maleates, and mono- and distearyl maleates. In addition to the unsaturated carboxylic acids it is also possible for up to 90% of other monomers, such as vinyl acetate, vinyl propionate, vinylsulfonic acid, vinyl stearate, styrene, olefins such as ethylene, propylene, butene, isobutene, diisobutene, hexene, octene, octadecene, $C_{20}/C_{24}$ olefin, cyclopentene, cyclopentadiene, cyclohexene, and butadiene, and vinyl ethers such as methyl vinyl ether, isobutyl ethers, butanediol monovinyl ether ethoxylates, allyl alcohol ethyoxylates or furan to be present. The polycarboxylates are prepared by known methods of free-radical polymerization in the form of a solution or precipitation polymerization in water, polyalkylene glycols, nonionic surfactants, acetone, toluene, o-xylene, isopropanol or other organic solvents. Free-radical initiators used are all initiators which are customarily employed. If low molecular mass polymers are desired it is also possible to carry out polymerization in the presence of regulators. According to one embodiment of the invention, the polycarboxylates are used in the form of the sodium or potassium salt. This applies in particular to copolymers of maleic anhydride, which are usually insoluble in water and other solvents. In the hydrolyzed alkali metal salt form, then, they are usually soluble or at least dispersible in water.

Also suitable according to one embodiment of the invention are graft polymers of acrylic acid, methacrylic acid, maleic acid, vinylsulfonic acid, methallylsulfonic acid, methacrylic acid and glucose, polysaccharides, such as starch or starch hydrolyzates, proteins, protein hydrolyzates or polyalkylene glycols. Examples are graft polymers of acrylic acid and maleic acid on maltodextrins, graft polymers of maleic acid and starch, graft polymers of acrylic acid and casein, and graft polymers of acrylic acid, methyl methacrylate and gelatin.

Typical polycarboxylates which can be employed according to the invention are polyacrylic acids having molecular weights of between 1,000 and 250,000, 70/30 acrylic acid-maleic acid copolymers with a molecular weight of 70,000, 40/60 acrylic acid-maleic acid copolymers with a molecular weight of 40,000, maleic acid-isobutene copolymers with a molecular weight of 4,000, maleic acid-diisobutene copolymers with a molecular weight of 12,000, maleic acid-styrene copolymers with a molecular weight of 20,000, maleic acid-$C_{20}/C_{24}$ olefin copolymers with a molecular weight of 15,000, polyvinylsulfonic acid with a molecular weight of 1,000, polymaleic acid with a molecular weight of 1,000, polyaspartic acids with molecular weights of between 1,000 and 50,000, acrylic acid-maleic acid-vinyl acetate terpolymers with a molecular weight of 40,000, graft polymers of acrylic acid and maleic acid on maltodextrins, with a molecular weight of 40,000, graft polymers of acrylic acid and polyethylene glycols, with a molecular weight of 60,000, and graft polymers of acrylic and maleic acids and polyethylene glycols, with a molecular weight of 20,000.

According to one embodiment, the polycarboxylates are devoid of aromatic radicals.

Components (b)

As component (b) of the novel mixtures use is made of at least one amine having a $pK_a$ of more than 9, preferably from 9.5 to 12.

According to one embodiment the amines contain only aliphatic, cycloaliphatic and/or araliphatic radicals, the latter being those in which aromatic radicals are attached via alkylene to the amine nitrogen.

According to one embodiment of the invention, the amines which can be used have the formula (II)

$$R^5NR^9—[(CR^7R^8)_m—NH]_n—R^6 \quad (II)$$

where n is an integer from 0 to 20 and m is an integer from 1 to 4, $R^5$ is a $C_{1-30}$, preferably $C_{1-20}$, in particular $C_{1-10}$ alkyl, or $C_{2-30}$, preferably $C_{2-20}$, in particular $C_{2-10}$ alkenyl and each of $R^6$, $R^7$, $R^8$ and $R^9$ independently is hydrogen or is as defined for $R^5$.

According to one embodiment of the invention n is zero, $R^5$ is $C_{6-20}$ alkyl or an alkenyl, $R^6$ is $C_{1-4}$ alkyl or $C_{2-4}$ alkenyl, and $R^9$ is hydrogen, $C_{1-4}$ alkyl or $C_{2-4}$ alkenyl.

According to one embodiment of the invention, when used in a detergent the amine has a $pK_a$ which is greater than the pH minus 1, preferably greater than the pH, particularly preferably at least 0.5 greater than the pH of the 1% strength liquor formed from the detergent. In this context the $pK_a$ is the value for the corresponding acid of the amine—that is to say, of the protonated amine—and is equal to 14-$pK_b$ of the amine.

As component (b) it is preferred to employ mono- or polyamines, preferably having at least 4 carbons. The amines may be primary, secondary or tertiary and may be hydrophilic or hydrophobic.

According to one embodiment of the invention, component (b) comprises primary amines having preferably 3 to 20, especially 4 to 10, carbons, such as butylamine, tert-butylamine, sec-butylamine, ethylhexylamine, 2-methylheptylamine, octylamine, 2-ethylhexylamine, nonylamine, decylamine, 2-propylheptylamine, undecylamine, cetylamine, tridecylamine, isotridecylamine, fatty amines, such as oleylamine, stearylamine, octadecylamine, tallow fatty amine, hydrogenated tallow fatty amine, amines based on coconut fatty acids, polyisobutenamine, polypropylenamine, alkyl polyethylene oxide amines which can be prepared by aminating alkyl polyglycols. Polyfunctional primary amines are, for example, 1,6-diaminohexane, 1,8-diaminooctane, 1,3-diaminopropane, isophoronediamine, polyoxyalkylenediamines, such as polyethylene oxide diamine, polypropylene oxide diamine, polybutylene oxide diamine, polytetrahydrofurandiamine, co(polyethylene oxide/propylene oxide)amines which can be prepared by aminating polyalkylene oxides, and aminated alkoxylated fatty alcohols and oxo alcohols, such as aminated reaction products of one mole of $C_{16}/C_{18}$ oxo alcohol and seven moles of ethylene oxide, which has been subsequently aminated. These types of amine can be termed ether amines.

According to one embodiment of the invention, component (b) comprises secondary dialkyl amines having preferably 5 to 40, especially 8 to 46 carbons, such as N,N-dibutylamine, N,N-dihexylamine, N,N-diisopentylamine, N,N-dipentylamine, N,N-diethylhexylamine, N,N-di-tallow fatty amine, hydrogenated N,N-di-tallow fatty amine, N,N-distearylamine, N,N-dioleylamine, mixed secondary amines such as N-methyl-N-octylamine, N-methyl-N-stearylamine, N-methyl-N-tallow fatty amine, hydrogenated N-methyl-N-tallow fatty amine, N-methyl-N-decylamine, N-methyl-N-octyl amine, N-methyl-N-ethylhexylamine, alkanolamines, or reaction products of primary and secondary amines with 1–100 mol, preferably 1–20 mol, especially 1–15 mol of ethylene oxide and/or propylene oxide, such as reaction products of isotridecylamine with 7 mol of ethylene oxide, reaction products of N-methyl-N-tallow fatty amine with 10 mol of ethylene oxide and 3 mol of propylene oxide, of tallow fatty amine with 1 mol of ethylene oxide, oleylamine with 3 mol of ethylene oxide, of tallow fatty amine with 3 mol of ethylene oxide and 1 mol of propylene oxide, of hydrogenated tallow fatty amine with 2 mol of ethylene oxide, and of stearylamine with 1 mol of ethylene oxide. According to one embodiment of the invention it is also possible to use reaction products of primary and secondary amines with other epoxides, such as mono- and polyfunctional glycidyl ethers, such as butyl glycidyl ether, ethylhexyl glycidyl ether, $C_{12}/C_{14}$ alcohol glycidyl ether, $C_{13}/C_{15}$ alcohol glycidyl ether, 1,4-butanediol diglycidyl ether, 1,6-hexanediol diglycidyl ether, phenyl glycidyl ether, o-cresyl glycidyl ether, and polypropylene glycidyl ethers. As epoxides it is possible in accordance with the invention also to use long-chain epoxides, for example epoxidized castor oil, or alkyloxiranes which can be prepared by epoxidation of olefins, such as propyloxirane, decyloxirane, dodecyloxirane and octadecyloxirane.

According to one embodiment of the invention it is also possible to employ tertiary amines, preferably those having 6–60, especially 9–54, carbons. Examples are tributylamine, trioctylamine, tridecylamine, tridodecylamine, dimethyldodecylamine, dimethyllaurylamine, dimethyl coconut fatty amine, dimethylcetylamine, dimethylstearylamine, dimethyloctadecylamine, methyldioctylamine, methyldodecylamine, methyldi-coconut oil amine, methyldi-tallow fatty amine, hydrogenated methyldi-tallow fatty amine, methyldioctadecylamine, dimethyl-$C_{12}/C_{14}$-amine, N,N-dimethylcyclohexylamine.

According to one embodiment of the invention it is also possible to employ polyfunctional amines which possess not only primary amino but also secondary or tertiary amino groups, preferably with 3 to 60, especially 4 to 40 carbons, examples being alkylaminoalkylamines such as 2-ethylaminoethylamine, tallow fatty aminopropylamine, hydrogenated tallow fatty aminopropylamine, coconut oil-aminopropylamine, oleylaminopropylamine (commercially available, for example, as Duomeen® from Akzo), 3-isopropylaminopropylamine, or dialkylaminoalkylamines, such as 3-methyl-tallow fatty aminopropylamine, 3-di-tallow fatty aminopropylamine, 2-dimethylaminoethylamine, 1-diethylamino-4-aminopentane and dimethylaminopropylamine.

According to one embodiment of the invention it is also possible to employ oligomeric or polymeric amines having, for example, secondary amino groups, preferably with a weight-average molecular weight of from 100 to 250,000, in particular from 200 to 100,000. Examples are diethylenetriamine, triethylene tetraamine, polyethyleneimine, polyvinylamine, copolymers of vinylamine and vinylformamide, alkylaminopolyalkyleneamines, such as N-tallow fatty tripropylenetetraamine, or dialkylamino-polyalkyleneamines, such as N,N-di-tallow fatty dipropylene triamine.

Futhermore, according to one embodiment of the invention it is possible to employ amido amines, preferably those having a weight-average molecular weight of from 200 to 100,000, in particular from 250 to 80,000, which can be prepared by subjecting mono- and polybasic carboxylic acids and at least difunctional amines to condensation and which contain at least one basic amino group, examples being a condensation product of 1 mol of stearic acid with 1 mol of hexamethylenediamine, a condensation product of 1 mol of oleic acid with 1 mol of ethylenediamine, a condensation product of 1 mol of $C_{10}/C_{12}$ fatty acid with 1 mol of isophoronediamine, a condensation product of 1 mol of adipic acid with 2 mol of hexamethylenediamine, a condensation product of 1 mol of phthalic acid with 2 mol of ethylenediamine, a condensation product of 1 mol of oleic acid with 1 mol of ethylenediamine, a condensation product of 2 mol of adipic acid with 3 mol of hexamethylenediamine, a condensation product of 3 mol of terephthalic acid with 2 mol of butylenediamine, and a condensation product of 4 mol of adipic acid with 3 mol of hexamethylenediamine.

As amines it is possible, in accordance with one embodiment of the invention, to employ ester amines as well, preferably those having a weight-average molecular weight of from 200 to 100,000, in particular from 300 to 10,000, which can be prepared by esterification of alkanolamines with carboxylic acids, examples being esters of stearic acid and ethanolamine, esters of oleic acid and N,N-dimethylethanolamine, esters of tallow fatty acid and diethanolamine, esters of coconut fatty acid and triethanolamine, and esters of phthalic acid and ethanolamine.

It is also possible in accordance with one embodiment of the invention to employ N-alkyl-, N-alkenyl- or N-hydroxyalkylglucamines, or the corresponding morpholines, having up to 30 carbons.

The amine preferably comprises at least one amine having at least four carbons, preferably tallow fatty amine, hydrogenated tallow fatty amine, octylamine, 2-ethylhexylamine, nonylamine, decylamine, 2-propylheptylamine, undecylamine, dodecylamine, tridecylamine, cetylamine, stearylamine, palmitylamine, oleylamine, coconut fatty amine, mono-α-branched secondary amines, bis-α-branched secondary amines of the formula (I)

$$R^4R^3HC—HN—CHR^1R^2 \quad (I)$$

where $R^1$–$R^4$ independently of one another are substituted or unsubstituted $_{1-20}$ alkyls.

Component (c)

Component (c) of the novel mixture is at least one acid selected from the group consisting of mineral acids and organic acids having one or two carboxyls and containing, according to one embodiment, no aromatic radicals.

Preference is given here to phosphorus-containing acids.

As component (c) it is possible to employ saturated or unsaturated organic acids having one or two carboxyls and preferably up to 15 carbons, especially up to 10 carbons, such as formic, acetic, propionic, capric, oxalic, succinic, adipic, maleic, fumaric, sebacic, malic, lactic, glycolic, tartaric and glyoxylic acids, and also mineral acids.

Examples of novel mineral acids are hydrochloric, sulfuric, sulfurous, metalsilicic and boric acid, heteropoly acids of tungsten or molybdenum, acidic ion exchangers, acidic silicates or alumosilicates, benzenesulfonic acid, toluenesulfonic acid and naphthalenesulfonic acid. Phosphorus-containing acids are preferably employed, examples being phosphoric acid, diphosphoric acid, triphosphoric acid, polyphosphoric acid, phosphorous, hypophosphorous acid, phosphonic acid, primary and secondary phosphoric esters, primary and secondary phosphoramides, such as 2-ethylhexylphosphoramide, oleylphosphoramide or di-tallow fatty phosphoramide, and also phosphonic acids such as diethylenetriamine pentamethylene phosphnonic acid.

The novel mixtures comprising components (a), (b) and (c) contain, in accordance with the invention, less than 24% by weight, preferably not more than 20% by weight, of triphosphate, preferably not more than 10% by weight, and in particular not more than 5% by weight of triphosphate. According to one embodiment of the invention the mixtures are substantially or completely free from triphosphate.

The novel mixtures comprising components (a), (b) and (c) contain according to one embodiment of the invention not more than 20% by weight of LAS, preferably not more than 10% by weight, in particular not more than 5% by weight of LAS. According to one embodiment of the invention the mixtures are substantially or completely free form LAS.

Preparation of the mixtures

To prepare the mixtures, components (a), (b) and (c) can be mixed in any order. Preparation of the mixtures (abc) from polycarboxylate (a), amine (b) and acid (c) can be carried out in accordance with the following general scheme:

b+c→bc (salt formation)

bc→d (conditioning of the salt)

a+bc→abc (blending of polycarboxylate with salt)

a+d→ad a+b→ab ab+c→abc a+c→ac ac+b→abc

According to one embodiment of the invention the mixtures can be prepared by first of all neutralizing amine (b) and acid (c) at 10°–150° C. and then mixing the neutralization product (e.g. alkylammonium phosphate) into the polycarboxylate. The neutralization of amines and acids may take place in bulk or in a diluent. If in bulk, the procedure is carried out, for example, in an extruder at from 20° to 150° C., for example by metering, in accordance with one embodiment of the invention, phosphoric acid and melted tallow fatty amine into the extruder. The alkylammonium phosphate is discharged as a melt and can be processed in the form of extrudates or granules. As diluents for the neutralization, in accordance with one embodiment of the invention, it is possible to use water, acetone, methanol, ethanol, glycerol, surfactants, including nonionic surfactants, such as alkoxylation products of oxoalcohols or fatty alcohols, ethylene glycol, diethylene glycol, triethylene glycol, polyalkylene glycols, propylene glycol, dipropylene glycol, polypropylene glycol, copolymers of ethylene oxide and propylene oxide, and block-linked polyethylene glycols and polypropylene glycols.

If phosphoric acid is used as component (c), the mixtures can advantageously be prepared, in accordance with one embodiment of the invention, by first of all neutralizing alkylamines and phosphoric acids at from 10° to 150° C. and then heating the salt-like neutralization products at up to 250° C. At from 150° to 250° C. the conditioned alkylammonium phosphates undergo at least partial conversion, with elimination of water, into alkylammonium polyphosphates and alkylaminephosphoramides (component (d)). Condensation can be carried out in a diluent or, preferably, in bulk. Suitable diluents are high-boiling diluents such as glycerol, surfactants, including nonionic surfactants, ethylene glycol, diethylene glycol, triethylene glycol, polyalkylene glycols, propylene glycol, dipropylene glycol, polypropylene glycol, copolymers of ethylene glycol and propylene glycol, and block-linked polyethylene glycols and polypropylene glycols. The reaction apparatus used may be an extruder, compounder or paddle drier. The conditioned adducts of alkylamine with phosphoric acids are then mixed in with the polycarboxylate.

According to one embodiment of the invention the isolation of the reaction product of amine with acid can be avoided by using the polycarboxylate (a) in the form of an aqueous solution or, if it is not entirely soluble in water, then in the form of a suspension and adding first acids (c) and then amines (b). In the case of this procedure the polycarboxylates can be employed in the form of the anhydrides, acid forms or alkali metal salt forms. If the anhydrides or acids are used, then neutralization with alkalis can be carried out after adding the amines (b) and acids (c).

According to one exemplary embodiment of the invention, the mixtures can be prepared by adding first amines (b) and then acids (c) to the polycarboxylates (a) in the form of an aqueous solution or suspension. Subsequent neutralization can be carried out as described above.

If polymerization produces anhydrides of the polycarboxylates, then in accordance with one embodiment of the invention these anhydrides, too, can be blended with components (b) and (c). This can then be followed by hydrolysis with alkalis and conversion to an aqueous solution or suspension.

In detergents, the polycarboxylates are customarily employed in the form of the alkali metal salts. The polycarboxylates can be neutralized before or after the alkylamine and phosphoric acid have been mixed in. In most cases the mixtures are then neutralized to a pH of 6–10.

If the polycarboxylates are obtainable in solid form, then the polycarboxylate powders or granules can also be blended with the salts of (b) and (c). Solid polycarboxylates may be obtained in the form of powders or granules. For example, a solution of a copolymer of acrylic and maleic acid or its salt can be converted into a solid powder by spray drying or spray granulation. In the case of the precipitation polymerization of maleic anhydride and isobutene in organic solvents, a solid polycarboxylate powder is produced which contains the polycarboxylate in the anhydride form. Such or similarly prepared solid polycarboxylates can then be blended with solid adducts of the amines (b) and acids (c).

The solid adducts of (b) and (c) are obtained, for example, by reacting tallow fatty amine and phosphoric acid in the extruder and then shaping the melt, or by neutralizing the amines (b) and the acids (c) in a diluent in which the adduct of (b) and (c) is insoluble and precipitates. For example, 2-ethylhexylamine or tallow fatty amine can be reacted with phosphoric acid or polyphosphoric acid in acetone or toluene, so that the adduct is produced in the form of a powder.

The procedural options are illustrated below by way of example:

According to one embodiment of the invention, maleic anhydride and isobutene are subjected to free-radical precipitation polymerization in an organic solvent and the resulting polymer, in the anhydride form, is isolated by filtration. This anhydride-form polymer is suspended in water, alkylammonium phosphate is added, and then the mixture is neutralized with sodium hydroxide solution.

According to one embodiment of the invention it is also possible to hydrolyze the polymer of maleic anhydride and isobutene with sodium hydroxide solution, to give an aqueous sodium salt solution, and then to add alkylammonium phosphate. The aqueous sodium salt solution of the maleic acid-isobutene copolymer can also have added to it first alkylamine and then phosphoric acid. However, it is also possible to add first phosphoric acid and then tallow fatty amine. Another possibility is first to prepare a condensation product of tallow fatty amine and phosphoric acid, at 200° C., and then to add this to the aqueous sodium salt solution of the copolymer.

According to one embodiment of the invention it is possible to take an aqueous solution of polyacrylic acid in the acid form and to add first alkylamine and then phosphoric acid to it.

According to one embodiment of the invention it is possible first of all to neutralize a solution of polyacrylic acids with sodium hydroxide solution and then to add tallow fatty alkylphosphoramide.

The novel mixtures (abc) may give clear solutions in water. However, they may also form suspensions if one or more components of the mixture (abc) is insoluble in water. In such cases it may be useful to produce a very finely divided suspension by means of intensive stirring or shearing. This can be achieved with the aid of a dispersing and homogenizing machine, an intensive mixer, a high-speed rotating stirrer element equipped with cutting blades, a calender, or with the action of ultrasound.

The novel mixtures can be used in detergents, especially as encrustation inhibitors or scale inhibitors. In addition, they can be used in rinse aid formulations, especially as encrustation inhibitors or scale inhibitors.

Detergent formulations

The invention also relates to detergent formulations comprising at least one surfactant and a mixture of (a) at least one polycarboxylate having at least three carboxyl groups, (b) at least one amine whose $pK_a$ value is greater than the pH, reduced by 1, of a 1% strength liquor of the detergent, (c) at least one acid selected from the group consisting of mineral acids and organic acids having one or two carboxyls and not more than 10 carbons, and, if desired, other customary constituents, with the proviso that the detergent contains less than 24% by weight of triphosphate.

The invention additionally relates to detergents comprising at least one surfactant and a novel mixture with, if desired, other customary constituents.

According to one embodiment the detergents contain from 0.01 to 40% by weight, preferably from 0.1 to 30% by weight, in particular from 0.5 to 20% by weight of component (a), from 0.01 to 20% by weight, preferably from 0.03 to 10% by weight, in particular from 0.05 to 5% by weight, of component (b), and from 0.01 to 20% by weight, preferably from 0.02 to 10% by weight, in particular from 0.03 to 8% by weight, of component (c).

The mixtures of (a), (b) and (c) are employed in accordance with one embodiment in a proportion of form 0.1 to 20% by weight, preferably from 1 to 15% by weight, in detergent formulations.

The detergents can be in powder form or else in a liquid formulation. The composition of the detergents and cleaners may vary widely. Detergents and cleaner formulations normally contain from 2 to 50% by weight of surfactants and, where appropriate, builders. These data apply both to liquid and to powder detergents. Detergent and cleaner formulations customary in Europe, the USA and Japan are tabulated, for example, in Chemical and Engn. News, 67 (1989) 35. Further details on the composition of detergents and cleaners are to be found in Ullmanns Enzyklopädie der technischen Chemie, Verlag Chemie, Weinheim 1983, 4th Edition, pp. 63–160.

Reduced-phosphate detergents means formulations which contain not more than 25% by weight of phosphate, calculated as pentasodium triphosphate. The detergents can be heavy duty detergents or specialty detergents. Suitable surfactants are both anionic and nonionic, or mixtures of anionic and nonionic, surfactants. The preferred surfactant content of the detergents is from 8 to 30% by weight.

Surfactants

Examples of suitable anionic surfactants are fatty alcohol sulfates of fatty alcohols with 8 to 22, preferably 10 to 18, carbons, such as $C_9$–$C_{11}$-alcohol sulfates, $C_{12}$–$C_{13}$-alcohol sulfates, cetyl sulfate, myristyl sulfate, palmityl ulfate, stearyl sulfate and tallow fatty alcohol sulfate.

Other suitable anionic surfactants are sulfated, ethoxylated $C_8$–$C_{22}$-alcohols or their soluble salts. Compounds of this type are prepared, for example, by initially alkoxylating a $C_8$–$C_{22}$-alcohol, preferably a $C_{10}$–$C_{18}$-alcohol, and then sulfating the alkoxylation product. Ethylene oxide is preferably used for the alkoxylation, in which case from 2 to 50 mol, preferably from 3 to 20 mol, of ethylene oxide are employed per mole of fatty alcohol. However, the alcohols can also be alkoxylated using propylene oxide alone and, where appropriate, butylene oxide. Also suitable are those alkoxylated $C_8$–$C_{22}$-alcohols which contain ethylene oxide and propylene oxide or ethylene oxide and butylene oxide. The alkoxylated $C_8$–$C_{22}$-alcohols may contain the ethylene oxide, propylene oxide and butylene oxide units in the form of blocks or in random distribution.

Further suitable anionic surfactants are alkylsulfonates, such as $C_8$–$C_{24}$-, preferably $C_{10}$–$C_{18}$-alkanesulfonates, and also soaps, such as the salts of $C_8$–$C_{2_}$-carboxylic acids.

Other suitable anionic surfactants are N-acylsarcosinates having aliphatic saturated or unsaturated $C_8$–$C_{25}$-acyl radicals, preferably $C_{10}$–$C_{20}$-acyl radicals, such as N-oleylsarcosinate.

Further suitable anionic surfactants are any $C_9$–$C_{20}$-linear alkylbenzenesulfonates (LAS). The novel polymers are preferably employed in low-LAS detergent formulations containing less than 4% of LAS, particularly preferably in LAS-free formulations.

The anionic surfactants are preferably added to the detergent in the form of salts. Suitable cations in these salts are ions of alkali metals such as sodium, potassium and lithium, and ammonium ions, such as in hydroxyethylammonium, di(hydroxyethyl)ammonium and tri(hydroxyethyl) ammonium salts.

Examples of suitable nonionic surfactants are alkoxylated $C_8$–$C_{22}$-alcohols. Alkoxylation can be carried out with ethylene oxide, propylene oxide and/or butylene oxide. As surfactant in this connection it is possible to employ all alkoxylated alcohols which contain at least two molecules of one of the abovementioned alkylene oxides in the adduct. Also suitable in this connection are block polymers of ethylene oxide, propylene oxide and/or butylene oxide, or adducts which contain said alkylene oxides in random distribution. From 2 to 5 mol, preferably from 3 to 20 mol, of at least one alkylene oxide are used per mole of alcohol. Ethylene oxide is the preferred alkylene oxide used. The alcohols preferably have 10 to 18 carbons.

Another class of nonionic surfactants comprises alkyl polyglucosides with 8 to 22 carbons, preferably 10 to 18 carbons, in the alkyl chain. These compounds contain on average 1 to 20, preferably 1.1 to 5, glucoside units.

Another class of nonionic surfactants comprises N-alkylglucamides of the structures (III) and (IV)

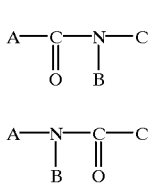

(III)

(IV)

where A is $C_6$–$C_{22}$-alkyl, B is H or a $C_1$–$C_4$-alkyl and C is polyhydroxyalkyl of 5 to 12 carbons and at least 3 hydroxyls. A is preferably $C_{10}$–$C_{18}$-alkyl, B is preferably $CH_3$ and C is preferably a $C_5$ or $C_6$ radical. Compounds of this type are obtained, for example, by acylating reductively aminated sugars with acid chlorides of $C_{10}$–$C_{18}$-carboxylic acids. The nonionic surfactants present in the detergent formulations are preferably $C_{10}$–$C_{16}$-alcohols ethoxylated with from 3 to 12 mol of ethylene oxide, particularly preferably ethoxylated fatty alcohols.

Further suitable and preferred surfactants are the endgroup-capped fatty acid amide alkoxylates of the formula (V)

$$R^1—CO—NH—(CH_2)_n—O—(AO)_x—R^2 \quad (V)$$

where $R^1$ is $C_5$–$C_{21}$-alkyl or -alkenyl, $R^2$ is $C_1$–$C_4$-alkyl,

A is $C_2$–$C_4$-alkylene, n is 2 or 3, and x is from 1 to 6, which are disclosed in WO 95/11225

Examples of such compounds are the products of the reaction of n-butyltriglycolamine of the formula $H_2N—(CH_2—CH_2O)_3—C_4H_9$ with methyl dodecanoate, or the products of the reaction of ethyltetraglycolamine of the formula $H_2N—(CH_2—CH_2—O)_4—C_2H_5$ with a commercial mixture of saturated $C_8$–$C_{18}$-fatty acid methyl esters.

Builders

The pulverulent or granular detergents and, where appropriate, also structured liquid detergents additionally contain one or more inorganic builders. Suitable such substances are all conventional inorganic builders, such as alumosilicates, silicates, carbonates and phosphates.

Examples of suitable inorganic builders are alumosilicates having ion-exchanging properties, such as zeolites. Various types of zeolite are suitable, especially zeolites A, X, B, P, MAP and HS, in their Na form or in forms in which Na is partly replaced by other cations such as Li, K, Ca, Mg or by ammonium. Suitable zeolites are described, for example, in EP-A-0 038 591, EP-A-0 021 491, EP-A-0 087 035, US 4 604 224, GB-A-2 013 259, EP-A-0 522 726, EP-A-0 384 070 and WO 94/24251.

Other suitable inorganic builders are, for example, amorphous or crystalline silicates, such as amorphous disilicates, crystalline disilicates, such as the phyllosilicate SKS-6 (manufacturer: Hoechst AG). The silicates can be employed in the form of their alkali metal, alkaline earth metal or ammonium salts. Ni, Li and Mg silicates are preferably employed.

Further appropriate inorganic builder substances are carbonates and bicarbonates, which can be employed in the form of their alkali metal, alkaline earth metal or ammonium salts. Preference is given to employing Na, Li and Mg carbonates and bicarbonates, especially sodium carbonate and/or sodium bicarbonate.

The inorganic builders can be present in the detergents in amounts of from 0 to 60% by weight, together with organic cobuilders which are used if desired. The inorganic builders can be incorporated, either alone or in any combination with one another, into the detergent. They are added to pulverulent or granular detergents in amounts of from 10 to 60% by weight, preferably from 20 to 50% by weight. Inorganic builders are employed in structured (multiphase) liquid detergents in amounts of up to 40% by weight, preferably up to 20% by weight. They are suspended in the liquid formulation constituents.

Pulverulent, granular and liquid detergent formulations contain organic cobuilders in amounts of from 0.1 to 20% by weight, preferably in amounts of from 1 to 15% by weight, together with the inorganic builders. The pulverulent or granular heavy duty detergents may additionally include, as other customary constituents, a bleaching system consisting of at least one bleach, combined if desired with a bleach activator and/or a bleach catalyst.

Bleaches

Suitable bleaches are perborates and percarbonates in the form of their alkali metal salts, especially their Na salts. They are present in the formulations in amounts of from 5 to 30% by weight, preferably from 10 to 25% by weight. Other suitable bleaches are inorganic and organic peracids in the form of their alkali metal or magnesium salts, or in some cases in the form of the free acids. Examples of suitable organic percarboxylic acids or salts thereof are Mg monoterephthalate, phthalimidopercaproic acid, and diperdodecane-1,10-dioic acid. One example of an inorganic peracid salt is potassium peroxomonosulfate (Oxone).

Examples of suitable bleach activators are

- acylamines, such as tetraacetylethylenediamine, tetraacetylglycoluril, N,N'-diacetyl-N,N'-dimethylurea and 1,5-diacetyl-2,4-dioxohexahydro-1,3,5-triazine
- acylated lactams, such as acetylcaprolactam, octanoylcaprolactam and benzoylcaprolactam
- substituted phenol esters of carboxylic acids, such as Na acetoxybenzenesulfonate, Na octanoyloxybenzenesulfonate and Na nonanoyloxybenzenesulfonate
- acylated sugars, such as pentaacetylglucose
- anthranil derivatives, such as 2-methylanthranil or 2-phenylanthranil
- enol esters, such as isopropenyl acetate oxime esters, such as O-acetyl acetone oxime carboxylic anhydrides, such as phthalic anhydride or acetic anhydride.

Tetraacetylethylenediamine and Na nonanoyloxybenzenesulfonate are preferably employed as bleach activators. The bleach activators are added to heavy duty detergents in amounts of from 0.1 to 15% by weight, preferably in amounts of from 1.0 to 8.0% by weight, particularly preferably in amounts of from 1.5 to 6.0% by weight.

Suitable bleach catalysts are quaternized imines and sulfone imines, as described in U.S. Pat. No. 5,360,568, U.S. Pat. No. 5,360,569 and EP-A-0 453 003, and Mn complexes, see WO 94/21777. If bleach catalysts are used in the detergent formulations, they are present therein in quantities of up to 1.5% by weight, preferably up to 0.5% by weight, and in the case of the highly active manganese complexes in quantities of up to 0.1% by weight.

Enzymes

The detergents preferably contain an enzyme system. This comprises proteases, lipases, amylases and cellulases normally employed in detergents. The enzyme system may be confined to a single enzyme or may comprise a combination of various enzymes. The commercial enzymes are added to the detergents, in general, in amounts of from 0.1 to 1.5% by weight, preferably from 0.2 to 1.0% by weight, of the formulated enzyme. Examples of suitable proteases are Savinase and Esperase (manufacturer: Novo Nordisk). An example of a suitable lipase is Lipolase (manufacturer: Novo Nordisk). An example of an appropriate cellulase is Celluzym (manufacturer: Novo Nordisk).

Other customary constituents

As other customary constituents, the detergents preferably contain soil release polymers and/or graying inhibitors (antiredeposition agents). Examples of these are polyesters of polyethylene oxides with ethylene glycol and/or propylene glycol and aromatic dicarboxylic acids or aromatic and aliphatic dicarboxylic acids, or polyesters of polyethylene oxides, which are endgroup-capped at one end, with dihydric and/or polyhydric alcohols and dicarboxylic acids. Polyesters of this kind are known; see U.S. Pat. No 3,557,039, GB-A-1 154 730, EP-A-0 185 427, EP-A-0 241 984, EP-A-0 241 985, EP-A-0 272 033 and U.S. Pat. No 5,142,020.

Further suitable soil release polymers are amphiphilic graft polymers or copolymers of vinyl and/or acrylic esters on polyalkylene oxides, see U.S. Pat. No 4,746,456, U.S. Pat. No 4,846,995, DE-A-3 711 299, U.S. Pat. No 4,904,408, U.S. Pat. No 4,846,994 and U.S. Pat. No 4,849,126, or modified celluloses, such asmethylcellulose, hydroxypropylcellulose or carboxymethylcellulose.

Graying inhibitors and soil release polymers are present in the detergent formulations in proportions of from 0 to 2.5% by weight, preferably from 0.2 to 1.5% by weight, particularly preferably from 0.3 to 1.2% by weight. Soil release polymers which are preferably employed are the graft polymers of vinyl acetate on polyethylene oxide of molecular mass 2,500–8,000 in a weight ratio of 1.2:1 to 3.0:1, known from U.S. Pat. No 4,746,456, and also commercial polyethylene terephthalate/polyoxyethylene terephthalates of molecular mass 3,000–25,000 from polyethylene oxides of molecular mass 750–5,000 with terephthalic acid and ethylene oxide, and with a molar ratio of polyethylene terephthalate to polyoxyethylene terephthalate of 8:1 to 1:1, and the block polycondensation products known from DE-A-44 03 866, which contain blocks of ester units of polyalkylene glycols with a molecular mass of 500–7,500 and aliphatic dicarboxylic acids and/or monohydroxymonocarboxylic acids, and blocks of ester units of aromatic dicarboxylic acids and polyhydric alcohols. These amphiphilic block copolymers have molecular masses of 1,500–25,000.

A typical pulverulent or granular heavy duty detergent may, for example, have the following composition:

3–50, preferably 8–30, % by weight of at least one anionic and/or nonionic surfactant, 5–50, preferably 15–42.5, % by weight of at least one inorganic builder, 5–30, preferably 10–25, % by weight of an inorganic bleach, 0.1–15, preferably 1–8, % by weight of a bleach activator, 0–1, preferably not more than 0.5, % by weight of a bleach catalyst, 0.05–5, preferably 0.2–2.5, % by weight of a color transfer inhibitor based on water-soluble homopolymers of N-vinylpyrrolidone or N-vinylimidazole, water-soluble copolymers of N-vinylimidazole and N-vinylpyrrolidone, crosslinked copolymers of N-vinylimidazole and N-vinylpyrrolidone having a particle size of 0.1–500 μm, preferably up to 250 μm, which copolymers contain 0.01–5, preferably 0.1–2, % by weight of N,N'-divinylethyleneurea as crosslinking agent. Other color transfer inhibitors are water-soluble and also crosslinked polymers of 4-vinylpyridine N-oxide, which are obtainable by polymerizing 4-vinylpyridine and then oxidizing the polymers;

0.1–20, preferably 1–15, % by weight of at least one novel mixture of components (a), (b) and (c), 0.2–1.0% by weight of protease, 0.2–1.0% by weight of lipase, 0.3–1.5% by weight of a soil release polymer, less than 24, preferably not more than 20, preferably not more than 10, % by weight of triphosphate, and especially no triphosphate, and according to one embodiment, not more than 20, preferably not more than 10, % by weight of LAS, and especially no LAS, the total amount of the ingredients being 100% by weight.

A bleaching system is often entirely or partly dispensed with in color-sparing specialty detergents (for example in color detergents). A typical color detergent in pulverulent or granular form may have, for example, the following composition:

3–50, preferably 8–30, % by weight of at least one anionic and/or nonionic surfactant, 10–60, preferably 20–55, % by weight of at least one inorganic builder, 0–15, preferably 0–5, % by weight of an inorganic bleach, 0.05–5, preferably 0.2–2.5, % by weight of a color transfer inhibitor (see above), 0.1–20, preferably 1–15, % by weight of at least one novel mixture of components (a), (b) and (c), 0.2–1.0% by weight of protease, 0.2–1.0% by weight of cellulase, 0.2–1.5% by weight of a soil release polymer, for example a graft polymer of vinyl acetate and polyethylene glycol, less than 24, preferably not more than 10, % by weight of triphosphate, and especially no triphosphate, and according to one embodiment, not more than 20, preferably not more 10, % by weight of LAS, and especially no LAS, the total amount of the ingredients being 100% by weight.

As other customary constituents the pulverulent or granular detergents may contain up to 60% by weight of inorganic fillers. Sodium sulfate is normally used for this purpose. However, the detergents of the invention preferably have a low filler content of up to 20% by weight, particularly preferably up to 8% by weight.

The bulk or apparent density of the novel detergents may vary in the range from 300 to 950 g/l. Modern compact detergents generally have high bulk densities, such as 550–950 g/l, and a granular structure.

The novel liquid detergents contain, for example,

5–60, preferably 10–40, % by weight of at least one anionic and/or nonionic surfactant, 0.05–5, preferably 0.2–2.5, % by weight of a color transfer inhibitor (see above), 0.1–20, preferably 1–15, % by weight of at least one novel mixture described above, 0–1.0% by weight of protease, 0–1.0% by weight of cellulase, 0–1.5% by weight of a soil release polymer and/or graying inhibitor, 0–60% by weight of water, and 0–10% by weight of alcohols, glycols such as ethylene glycol, diethylene glycol or propylene glycol, or glycerol, the total amount of the ingredients being 100% by weight.

The detergents may, where appropriate, comprise further customary additives. Examples of other additives which may be present where appropriate are complexing agents, phosphonates, fluorescent whiteners, dyes, perfume oils, foam suppressants and corrosion inhibitors.

Using the novel mixtures, the detergent formulations indicated below can be prepared. Compositions A–M are compact detergents, N and O are examples of color detergents, and formulation P is a structured liquid detergent. The meanings of the abbreviations are as follows:

| | |
|---|---|
| TAED: | Tetraacetylethylenediamine |
| Soil release additive 1: | Polyethylene terephthalate/-polyoxyethylene terephthalate in a molar ratio of 3:2, molecular mass of the co-condensed polyethylene glycol 4,000, molecular mass of the polyester 10,000 |
| Soil release additive 2: | Graft polymer of vinyl acetate on polyethylene glycol of molecular mass 8,000, molecular mass of the graft polymer 24,000 |
| EO: | Ethylene oxide. |

Detergent compositions A–P

| Constituents | A | B | C | D | E | F | G | H | I | J | K | L | M | N | O | P |
|---|---|---|---|---|---|---|---|---|---|---|---|---|---|---|---|---|
| lin. alkylbenzenesulfonate | | | 6 | 6 | 1 | 8 | 9 | 7.5 | | | | | | 2.5 | | 7 |
| $C_{12}$–$C_{18}$ alkylsulfate | 9 | 9 | 2 | 3 | 12 | | | 1.5 | 10 | 9 | 9 | 9 | 9 | 5 | 9 | 2 |
| $C_{12}$ fatty alcohol × 2 EO sulfate | | | | | | | | | 3 | | | | | | 2 | |
| $C_{12}$–$C_{18}$ fatty alcohol × 4 EO | | | | | | | | 3 | 4.5 | | | 4 | 4 | | | |
| $C_{12}$–$C_{18}$ fatty alcohol × 7 EO | 10 | 10 | | | | | | | | | | | | 13.5 | | 4 |
| $C_{13}$–$C_{15}$ oxo alcohol × 7 EO | | | 7 | | 5 | 8 | 10 | | | 10 | 10 | | | | | |
| $C_{13}$–$C_{15}$ oxo alcohol × 11 EO | | | | 4.5 | | | | 3 | | | | | | 2 | 7 | |
| $C_{16}$–$C_{18}$ glucamide | | | | | | | | | 4 | | | | | | | |
| $C_{12}$–$C_{14}$ alkyl polyglucoside | | | | | | | | | | | | 4 | | | | |
| $C_8$–$C_{18}$ fatty acid methyltetraglycol amide | | | | | | | | | | | | | 6 | | | |
| Soap | 2 | 2 | 1 | | 0.5 | 2 | 0.5 | 0.6 | 1 | 2 | 2 | 2 | 2 | 1.5 | 2 | |
| Na metasilicate × 5.5 $H_2O$ | 2 | 2 | 3.5 | | | 3 | | | | 2 | 2 | 2 | 2 | | | |
| Na silicate | | | | 8 | | | 2.5 | 4 | | | | | | 0.5 | | |
| Mg silicate | | | | | 0.8 | | | | | | | | 0.5 | | | |
| Zeolite A | 18 | 24 | 36 | 35 | 15 | 30 | 36.5 | 25 | 20 | 36 | 24 | 36 | 36 | | 55 | 25 |
| Zeolite P | 18 | | | | | | | | | | | | | 36 | | |
| Philosilicate SKS 6 (Hoechst AG) | | 12 | | | 14 | | | | 12 | | | | | | | |
| Amorphous sodium discilicate | | | | | | | | | | 12 | 12 | | | | | |
| Sodium carbonate | 12 | 12 | 12 | 11 | | 15 | 10.5 | 10 | 8 | | 12 | 12 | 12 | | 6 | |
| Sodium bicarbonate | | | | | 9 | | | | | | | | | 6.5 | | |
| Sodium citrate | | | | | 5 | | | 7 | 4 | | | | | | | 4 |
| TAED | 4 | 4 | 3.5 | 3.5 | 5.5 | 3 | 4 | 3.8 | 5 | 4 | 4 | 4 | 4 | | | |
| Perborate 4-$H_2O$ | | | | 20 | | 20 | | 24 | | | | | | | | |
| Perborate 2-$H_2O$ | | | 15 | | | | 14.5 | | | | | | | | | |
| Percarbonate | 15 | 15 | | | 18 | | | | 20 | 15 | 15 | 15 | 15 | | | |
| Carboxymethyl-cellulose | 1 | 1 | 1.5 | 2.5 | 0.5 | 2 | 1 | 1.3 | 1.5 | 1 | 1 | 1 | 1 | 1 | 1 | |
| Soil release additive 1 | 0.8 | 0.8 | 0.8 | | 0.5 | | | 0.5 | 0.5 | | | 0.5 | 0.5 | 0.5 | | |
| Soil release additive 2 | | | | | | | | | | | | 0.5 | 0.5 | | | |
| Lipase | | | | | 0.2 | 0.5 | | 0.5 | 0.5 | | | 0.5 | 0.5 | | | 0.5 |
| Protease | | | | | 0.5 | 0.5 | | 0.5 | 0.5 | | | 0.5 | 0.5 | | 1 | 0.5 |
| Cellulase | | | | | 0.3 | | | | | | | 0.2 | | | | 0.2 |
| Sodium sulfate | 3 | 3 | 3 | 1.5 | 3.5 | 3 | 3.5 | 2.4 | | 3 | 3 | 2.4 | 1.3 | 2 | | |
| Ethanol | | | | | | | | | | | | | | | | |
| Cobuilder 1 | 5 | 5 | 5 | 5 | 5 | 5 | 8 | 5 | 5 | 5 | 5 | 5 | 5 | 5 | 5 | 15 |
| Phosphonate | | | | | | | | | 0.2 | | | | 0.2 | | | 0.5 |

-continued

| Constituents | A | B | C | D | E | F | G | H | I | J | K | L | M | N | O | P |
|---|---|---|---|---|---|---|---|---|---|---|---|---|---|---|---|---|
| | Detergent compositions A–P | | | | | | | | | | | | | | | |
| Fluorescent whitener | 0.2 | 0.2 | 0.2 | | 0.2 | | | 0.2 | 0.2 | | | 0.2 | 0.2 | | | 0.2 |
| Color transfer inhibitor | | | | | | | | | | | | | | 1.5 | 1 | |
| Water | | | 3.5 | | 3.5 | | | | 0.3 | 1 | 1 | 1 | | 22.5 | 11 | 40.6 |

Rinse aid formulations

The mixtures of (a), (b) and (c) as described above are used in accordance with one embodiment of the invention in rinse aid formulations, especially as encrustation inhibitors and/or scale inhibitors.

The preferred embodiments of the compositions and quantities (amounts, proportions) indicated above apply to the rinse aid formulations as well.

The dishwashing compositions can be pulverulent or else can be present in liquid formulation. The composition of the dishwashing compositions may vary greatly. They include, commonly, sodium citrate, sodium carbonate and sodium disilicate. Rinse aid formulations are set out below by way of example.

EXAMPLE 2

Preparation of tallow fatty amine phosphoric acid salt 13.5 g of tallow fatty amine are melted at 60° C. in a glass beaker and, while stirring with a spatula, 6.5 g of 75% strength phosphoric acid are added. The temperature of the paste rises. Cooling gives a soft wax which is easy to cut up.

EXAMPLE 3

20 g of the salt prepared in Example 1 are placed in a 100 ml round-bottomed flask which is flushed with nitrogen, and are heated at 200° C. for 4 hours. After cooling, the wax-like contents are comminuted and analysed. The product consists ⅓ of tallow fatty amine phosphoric acid salt and ⅔ of a condensation product of tallow fatty amine and phosphoric acid.

| Ingredients | A | B | C | D | E | F | G | H | I | K | L | M | N | O | P |
|---|---|---|---|---|---|---|---|---|---|---|---|---|---|---|---|
| | Rinse aid formulations A–P | | | | | | | | | | | | | | |
| Na citrate * $2H_2O$ | 30 | 20 | — | — | 20 | 30 | 35 | 45 | — | 35 | — | — | — | — | — |
| Na carbonate | — | 20 | 34 | — | 40 | 27 | 25 | 15 | — | 15 | 10 | 5 | 20 | — | — |
| Na hydrogencarbonate | — | — | — | 47 | — | 27 | 7 | 15 | 67 | — | — | — | 35 | — | — |
| Na disilicate | 31.2 | 15 | 29 | 10 | 24 | — | 15 | 5 | — | — | — | — | — | — | — |
| Crystalline Na silicate ($\delta$-$Na_2Si_2O_5$) | — | — | — | — | — | — | — | — | — | 25 | — | — | — | — | — |
| Na metasilicate | — | — | — | — | — | — | — | — | — | — | 50 | 31 | — | — | — |
| Na triphosphate | — | — | — | — | — | — | — | — | — | — | 20 | — | 30 | — | — |
| Complexing agents[1] | — | 5 | 10 | — | — | — | — | — | 15 | — | — | 20 | — | — | 20 |
| Sodium hydroxide | — | — | — | — | — | — | — | — | — | — | — | 20 | — | — | — |
| Aqueous KOH solution | — | — | — | — | — | — | — | — | — | — | — | — | — | 60 | 60 |
| Na perborate monohydrate | 4 | 4 | — | — | 7 | 7 | 5 | 8 | 8 | — | — | 15 | — | — | — |
| Na perborate tetrahydrate | 8 | 8 | — | — | — | — | — | — | — | — | — | — | — | — | — |
| Na percarbonate | — | — | 15 | 15 | — | — | — | — | — | 12 | — | — | 15 | — | — |
| TAED | 4 | 4 | 2 | 2 | 2 | 2 | — | 3 | 3 | 3 | — | 4 | 3 | — | — |
| Nonionic low-foam surfactant | 1.5 | 1.5 | 2 | 2 | 2 | 2 | 4 | 2 | 2 | 2 | 2 | 2 | 2 | — | — |
| Enzymes (protease + amylase) | 4 | 4 | 3 | 3 | — | — | 3 | 2 | 2 | 3 | — | — | 3 | — | — |
| Phosphonate[2] | 0.3 | — | — | — | — | — | — | — | — | — | — | — | — | 1 | — |
| Na gluconate | — | — | — | 15 | — | — | — | — | — | — | — | — | — | — | — |
| Polymeric scale inhibitor | 7 | 6 | 5 | 6 | 5 | 5 | 6 | 5 | 3 | 6 | 3 | 3 | 2 | 6 | 4 |
| Na sulfate | 10 | 12.5 | — | — | — | — | — | — | — | — | 13 | — | — | — | — |
| Na dichloroisocyanurate | — | — | — | — | — | — | — | — | — | — | 2 | — | — | — | — |
| Potassium waterglass (30%) | — | — | — | — | — | — | — | — | — | — | — | — | — | 7 | 5 |
| Water | — | — | — | — | — | — | — | — | — | — | — | — | — | 26 | 11 |

[1]NTA, MGDA, EDDS, ADA
[2]HEDP, PBTC, ATMP

In the text below, the novel mixtures, detergents and cleaning compositions are illustrated in more detail with reference to examples. Unless specified otherwise, percentages are by weight.

EXAMPLE 1

Preparation of tallow fatty amine phosphoric acid salt 535 g of tallow fatty amine are dissolved in 1500 ml of acetone, and 261 g of 75% strength phosphoric acid are added with stirring. The precipitate is filtered off using a suction filter and dried. The yield is 720 g. The salt has a wax-like consistency.

EXAMPLE 4

Preparation of tallow fatty amine polyphosphoric acid salt 56 g of tallow fatty amine are dissolved at 70° C. in 150 ml of toluene, and 16 g of polyphosphoric acid are added over the course of 15 minutes. The resulting precipitate is filtered off with suction and dried.

EXAMPLE 5

13.7 g of tallow fatty amine are dissolved at 60° C. in 40 g of glycerol, and 6.5 g of 75% strength phosphoric acid are added. A viscous paste is obtained.

EXAMPLES 6–8

Tallow fatty amine, a reaction product of a $C_{16}/C_{18}$-oxo alcohol with 7 mol of ethylene oxide (nonionic surfactant), and water are prepared at 60° C. in a glass beaker in accordance with Table 1, and 75% strength phosphoric acid is added. Viscous pastes are obtained which on cooling solidify to give soft wax-like substances.

TABLE 1

| Example No. | Tallow fatty amine [g] | Nonionic surfactant [g] | Water [g] | 75% phosphoric acid [g] |
|---|---|---|---|---|
| 6 | 50 | 20 | 30 | 32 |
| 7 | 50 | 40 | 10 | 32 |
| 8 | 30 | 40 | 30 | 14 |

Preparation of the blends

EXAMPLE 9

Aqueous solutions of polycarboxylates in the sodium form are admixed with tallow fatty amine phosphoric acid salt in accordance with Table 2, and the mixtures are very finely dispersed using a dispersion apparatus (Ultra Turrax). Depending on the polymer, the result varies from clear solutions to cloudy suspension.

TABLE 2

| Example No. | 100 g of polymer solution No. | Tallow fatty amine phosphoric acid salt from Ex. 1 [g] | Tallow fatty amine phosphoric acid salt from Ex. 4 [g] | Blend appearance | Solids content of the mixture [%] |
|---|---|---|---|---|---|
| 9 | 1 | 4.0 | — | S | 43 |
| 10 | 2 | 4.3 | — | L | 48 |
| 11 | 3 | 4.5 | — | S | 50 |
| 12 | 4 | 4.5 | — | S | 46 |
| 13 | 1 | — | 4.0 | S | 44 |
| 14 | 2 | — | 4.3 | L | 48 |
| 15 | 3 | — | 4.5 | S | 48 |
| 16 | 4 | — | 4.5 | S | 45 |

Polymer No.1: Copolymer of maleic acid and acrylic acid in a ratio of 70:30 in the form of the sodium salt, 40% strength, molecular weight 70,000

Polymer No.2: Copolymer of maleic acid and diisobutene in the form of the sodium salt, 44% strength, molecular weight 4,000

Polymer No.3: Polyacrylic acid in the form of the sodium salt, 45% strength, molecular weight 8,000

Polymer No.4: Polyaspartic acid, sodium salt, 42% strength, molecular weight 30,000

S: cloudy solution

L: clear solution

EXAMPLE 17

40 g of a maleic anhydride-isobutene copolymer with a molecular weight of 6,000 (which is in the anhydride form) are suspended in 40 ml of water, and 4 g of tallow fatty amine phosphoric acid salt are added. The suspension is neutralized with 50% strength by weight sodium hydroxide solution until the pH of the solution is 7–8 and the polymer has dissolved. The solids content of the solution is 44%.

EXAMPLE 18

40 g of the polymer from Example 17 are suspended in 40 ml of water, 4 g of tallow fatty amine polyphosphoric acid salt are added, and hydrolysis is carried out with sodium hydroxide solution. The solids content of the resulting solution is 43%.

EXAMPLE 19

0.1 kg of the tallow fatty amine phosphoric acid salt from Example 1 is mixed in a paddle mixer with 0.9 kg of a pulverulent copolymer of 70% acrylic acid and 30% maleic acid in the sodium salt form which has been prepared by spray drying an aqueous solution. A powder with good free-flow properties is obtained.

0.05 kg of the powder mixture is mixed in a paddle mixer with 0.95 kg of a pulverulent detergent until uniform distribution is attained.

The resulting powder detergent C then has the following composition:

| | |
|---|---|
| Zeolite A | 36% |
| Sodium carbonate | 12% |
| Na dodecylbenzenesulfonate | 6% |
| Na $C_{12}/C_{18}$-alkyl sulfate | 2% |
| Soap | 1% |
| Reaction products of $C_{13}/C_{15}$-oxo alcohol and 7 mol of ethylene oxide | 7% |
| Na metasilicate × 5 $H_2O$ | 3.5% |
| TAED | 3.5% |
| Tylose CR 1500 | 1.5% |
| Sodium sulfate | 3% |
| Na perborate monohydrate | 15% |
| Water | 4.5% |
| Mixture of 10% tallow fatty amine phosphoric acid salt and 90% copolymer of 70% acrylic acid and 30% maleic acid in the sodium form | 5% |

Using the novel mixtures from Examples 1 to 8, the detergent formulations described in Table 3 were prepared using the powder detergent C.

Table 3 contains the results obtained in the course of testing the encrustation-inhibiting action. The detergent formulations described in the table were used for washing cotton test fabric. The number of washing cycles was 15. After this washing operation, the ash content of the fabric was determined by incinerating each of the test fabrics.

| Washing conditions | |
|---|---|
| Machine: | Launder-o-meter from Atlas, Chicago |
| Number of wash cycles: | 15 |
| Wash liquor: | 250 ml of liquor |
| Washing period: | 30 min at 60° C. |
| Detergent dosage: | 4.5 g/l |
| Water hardness: | 22.4° dH [German hardness] (4 mmol Ca/l; Ca:Mg = 4:1) |
| Test fabric: | 20 g of cotton cheesecloth |

TABLE 3

Inhibition of encrustation by various cobuilders and mixtures

| Example | Comparative example | Cobuilder mixtures according to Example | Detergent formulation in accordance with Table 2 | Content of mixture in the formulation [%] | Ash [%] |
|---|---|---|---|---|---|
| 20 | | 9 | C | 5 | 1.89 |
| 21 | | 10 | C | 5 | 1.05 |
| 22 | | 11 | C | 5 | 2.07 |
| 23 | | 12 | C | 5 | 3.2 |
| 24 | | 13 | C | 5 | 1.37 |
| 25 | | 14 | C | 5 | 0.59 |
| 26 | | 15 | C | 5 | 0.6 |
| 27 | | 16 | C | 5 | 1.22 |
| | 1 | none added | C | 0 | 5.2 |
| | 2 | polymer solution 1 | C | 5 | 3.87 |
| | 3 | polymer solution 2 | C | 5 | 3.35 |
| | 4 | polymer solution 3 | C | 5 | 2.89 |
| | 5 | polymer solution 4 | C | 5 | 4.38 |

From the results in Table 3 it is evident that the formulation of ash in test fabrics is considerably reduced when the novel mixtures are used. This corresponds to a substantially improved inhibition of encrustation on the fabric.

Dishwashing compositions

The dishwashing composition E was formed by mixing, and has the following composition:

| | |
|---|---|
| sodium citrate * $2H_2O$ | 20% |
| sodium disilicate, amorphous | 24% |
| sodium carbonate | 40% |
| sodium perborate * $1H_2O$ | 7% |
| TAED | 2% |
| nonionic low-foam surfactant | 2% |
| scale inhibitor | 5% |

Examples of the scale inhibitor are as follows:

a) mixture of 10% tallow fatty amine phosphoric acid salt and 90% copolymer of 70% acrylic acid and 30% maleic acid in the sodium form b) mixture of 10% tallow fatty amine phosphoric acid salt and 90% copolymer of 50% maleic acid and 59% isobutene in the sodium form c) mixture of 10% tallow fatty amine phosphoric acid salt and 90% polyacrylic acid (MW: 8000) in the sodium form d) mixture of 10% tallow fatty polyamine phosphoric acid salt and 90% polyacrylic acid The test for scale-inhibiting action is carried out by using 4 g of the abovedescribed rinse aid formulation per liter of drinking water of 10° dH [German hardness]. In a domestic dishwasher of type Miele G 590 SC, 15 wash cycles are conducted with a load consisting of black porcelain plates, knives and glasses. After the 15 wash cycles, the load was assessed visually. The rating 0 denotes that even after 15 cycles no scale can be seen on the load, whereas the rating 9 denotes very severe scale. The ratings 1–8 are grades lying between the ratings 0 and 9. The washing results are indicated in the table. As can be seen from that table, the mixtures of amines and phosphoric acid and polycarboxylate are better scale inhibitors than the polycarboxylates used conventionally.

TABLE 4

Dishwashing compositions E

| Example | Comparative Example | Addition of polymer | Rating on Plastic | Porcelain | Knife | Glass |
|---|---|---|---|---|---|---|
| | 6 | none | 9 | 5 | 6 | 7 |
| | 7 | Na polyacrylate MW: 8000 | 9 | 3–4 | 4 | 4 |
| | 8 | Copolymer Na-MA/AA MW: 70,000 | 4–5 | 4 | 2–3 | 4 |
| | 9 | Copolymer Na-MA/IB MW: 4000 | 4–5 | 2–3 | 2 | 4 |
| 28 | | c | 3–4 | 2 | 2 | 3–4 |
| 29 | | a | 3–4 | 2–3 | 3 | 3 |
| 30 | | b | 2 | 1 | 1 | 1–2 |
| 31 | | d | 2 | 1 | 1 | 2 |

We claim:

1. A mixture suitable for inhibiting encrustation and scaling on hard surfaces, comprising:

(a) from 0.1 to 99% by weight of at least one polycarboxylate having at least 3 carboxyls, wherein the polycarboxylate comprises at least one of the structural units selected from the group consisting of acrylic acid, maleic acid, maleic anhydride, aspartic acid and, optionally, isobutene and diisobutene, which may be in the form of an alkali metal salt, (b) from 0.1 to 99% by weight of at least one amine selected from the group consisting of tallow fatty amine, hydrogenated tallow fatty amine, octylamine, 2-ethylhdxylamine, nonylmine, decylamine, 2-propylheptylamine, undecylamine, dodecylamine, tridecylamine, cetylamine, stearylamine, palmitylamine, oleylamine, coconut fatty amine, mono-alpha-branched secondary amines, bis-alpha-branched secondary amines of the formula (I):

$$R^4R^3HC—HN—CHR^1R^2 \quad (I),$$

wherein $R^1$, $R^2$, $R^3$, and $R^4$ independently are substituted or unsubstituted $C_1$–$C_{20}$ alkyl, and amines of the formula (II):

$$R^5NR^9—[(CR^7R^8)m—NH]_n—R^6 \quad (II),$$

wherein n is an integer from 0 to 20 and m is an integer from 1 to 4, $R^5$ is a $C_{1-30}$ alkyl, or a $C_{2-30}$ alkenyl, and each of $R^6$, $R^7$, $R^8$, and $R^9$ independently is hydrogen or is as defined for $R^5$, and (c) from 0.1 to 99% by weight of at least one acid selected from the group consisting of phosphoric acid, diphosphoric acid, triphosphoric acid, polyphosphoric acid, phosphorus acid, hypophosphorous acid, and phosphonic acid, with the proviso that the mixture contains less than 24% by weight of triphosphates and the total amount of the ingredients is 100% by weight.

2. A method of inhibiting encrustation in detergents, comprising admixing a mixture as claimed in claim 1 in detergents.

3. A method of inhibiting encrustation or scale in rinse aid formulations, comprising the step of admixing a mixture as claimed in claim 1 in rinse aid formulations.

4. A detergent or rinse aid formulation suitable for inhibiting encrustation and scaling on hard surfaces, comprising: at least one surfactant and a mixture comprising:

(a) from 0.1 to 99% by weight at least one polycarboxylate having at least three carboxyl groups, wherein the polycarboxylate comprises at least one of the structural units selected from the group consisting of acrylic acid, maleic acid, maleic anhydride, aspartic acid and optionally, isobutene and diisobutene, which may be in the form of an alkali metal salt, (b) from 0.1 to 99% by weight at least one amine selected from the group consisting of tallow fatty amine, hydrogenated tallow fatty amine, octylamine, 2-ethylhdxylamine, nonylmine, decylamine, 2-propylheptylamine, undecylamine, dodecylamine, tridecylamine, cetylamine, stearylamine, palmitylamine, oleylamine, coconut fatty amine, mono-alpha-branched secondary amines, bis-alpha-branched secondary amines of the formula (I):

$$R^4R^3HC—HN—CHR^1R^2 \quad (I),$$

wherein $R^1$, $R^2$, $R^3$, and $R^4$ independently are substituted or unsubstituted $C_1$–$C_{20}$ alkyl, and amines of the formula (II):

$$R^5NR^9—[(CR^7R^8)m—NH]_n—R^6 \quad (II),$$

wherein n is an integer from 0 to 20 and m is an integer from 1 to 4, $R^5$ is a $C_{1-30}$ alkyl, or a $C_{2-30}$ alkenyl, and each of $R^6$, $R^7$, $R^8$, and $R^9$ independently is hydrogen or is as defined for $R^5$, (c) at least one acid selected from the group consisting of phosphoric acid, diphosphoric acid, triphosphoric acid, polyphosphoric acid, phosphorous acid, hypophosphorous acid, and phosphonic acid, and optionally, other customary constituents, with the proviso that the detergent or the rinse aid contains less than 24% by weight of triphosphate.

5. A detergent or rinse aid formulation comprising at least one surfactant and a mixture as claimed in claim 1 and, optionally, other customary constituents.

6. A detergent or rinse aid formulation as claimed in claim 4, comprising:

0.01–40% by weight of (a), 0.01–20% by weight of (b), and 0.01–20% by weight of (c), wherein the total amount of the ingredients being 100% by weight.

7. A method of inhibiting encrustation in textiles, comprising the step of cleaning textiles with a detergent formulation as claimed in claim 4.

8. A method of inhibiting encrustation and scaling on hard surfaces, comprising the step of cleaning hard surfaces with a rinse aid formulation as claimed in claim 4.

* * * * *